United States Patent [19]

Brazelton et al.

[11] Patent Number: 5,018,871

[45] Date of Patent: May 28, 1991

[54] POLYMER DILUTION AND ACTIVATION APPARATUS

[75] Inventors: Carl L. Brazelton, Kankakee; Troy C. Litherland, Bradley, both of Ill.

[73] Assignee: Stranco, Inc., Bradley, Ill.

[21] Appl. No.: 382,613

[22] Filed: Jul. 19, 1989

[51] Int. Cl.[5] ..... B01F 15/02

[52] U.S. Cl. ..... 366/168; 366/178

[58] Field of Search ..... 366/157, 164, 176, 178, 366/150, 154, 155, 159, 168, 169, 172, 177; 422/135

[56] References Cited

U.S. PATENT DOCUMENTS 4,514,139 4/1985 Gurth .

4,640,622 2/1987 Sortwell ..... 366/164

4,778,280 10/1988 Brazelton .

*Primary Examiner*—Robert W. Jenkins

*Attorney, Agent, or Firm*—Welsh & Katz, Ltd.

[57] ABSTRACT

Polymer activation apparatus includes an impeller in a mixing chamber having inlets for polymer and dilution water, and an outlet for removing the resulting solution. The impeller includes a circular disk having a plurality of internal channels which extend from an eye at the axis of the impeller to the impeller edge. The eye extends through the top surface of the impeller, and a shaft is secured to the bottom surface of the impeller to rotate it.

A polymer inlet and a water inlet are provided within about 1 inch of the impeller eye, and are oriented so that the polymer and water are placed directly into the eye of the impeller, within about 11 milliseconds of the initial mixing of the polymer and water.

1 Claim, 1 Drawing Sheet

POLYMER DILUTION AND ACTIVATION APPARATUS

This invention relates to apparatus for dissolving the type of water soluble synthetic polyelectrolytes (hereinafter referred to as polymers) which are manufactured and sold in the form of emulsions and dispersions, and more particularly, to apparatus for preventing or minimizing agglomeration of individual polymer gel particles, consisting of multiple individual polymer molecules, into aggregates when the polymer is introduced into water.

BACKGROUND OF THE INVENTION

Polymers are used at water treatment facilities for liquid/solid separation processes as an aid in the removal of undesired particles from water and wastewater. These concentrated liquid (emulsion and dispersion) polymers require dilution and activation at the water treatment facility prior to being introduced into the process stream. Owing to the nature of the polymer molecule, the dilution and activation processes must be carried out under carefully controlled conditions in order to assure optimum performance of the polymer.

The polymer is present in the emulsion in the form of microscopic gel particles consisting of thousands of individual long chain polymer molecules which are tightly intertwined and entangled with one another. Within milliseconds of the gel particle making contact with diluting water, the water begins to dissolve the polymer by penetrating into the particle, and activate the entangled molecules by loosening and extending them, swelling the polymer to many times its original size. As the water penetrates the particle, the molecules or section of molecules at the outside layer of the particle are only partially dissolved and become sticky. If particles in a similar condition are allowed to come into contact at this stage if dissolution, they will agglomerate into clumps which can range into macroscopic sizes. Once this happens the effective area to volume ratio of the clumps decreases and slows down dissolution greatly. These agglomerations must either be broken up by agitation so dissolution can be accomplished in a rapid manner, or a substantially longer time must be allowed for the polymer to dissolve, a technique referred to as aging. When additional agitation is applied, those molecules which are at or near the surface of the agglomerated particle will go into solution first. Once they are dissolved and fully extended they become fragile and are subject to being broken into shorter lengths, thereby decreasing their effectiveness. If aging is relied upon to complete dissolution, the time required will dictate very much larger mixing/aging vessels to achieve the necessary throughput for a given process. Accordingly, there is a need for methods and apparatus for preventing gel clumps or aggregates from forming in the dilution and activation processes.

Polymer agglomeration can be reduced or eliminated by subjecting the diluted polymer solution to relatively high shear forces, which can be obtained using a centrifugal impeller in a mixing chamber. A centrifugal impeller is a disk-shaped device which rotates, drawing solution into the impeller at the axis of rotation, and forcing it out at the outer edges under centrifugal force, through internal channels in the impeller. However, in some such apparatus the polymer is placed in the mixing chamber adjacent the outer edge of the chamber or impeller, where the shear forces are relatively low and not in immediate contact with fresh dilutant. This does not provide optimum conditions for discouraging agglomeration. In other such apparatus, the polymer and dilution water are placed in solution at least several seconds prior to entering the impeller chamber, which also does not produce optimum conditions for discouraging agglomeration. Thus, there is a need for polymer mixing and activation apparatus which minimizes polymer agglomeration and discourages gel aggregates from forming.

Accordingly, one object of this invention is to provide new and improved apparatus for dissolving and activating polymer emulsions in dilution water.

Another object is to provide new and improved apparatus for discouraging agglomeration of polymer molecules when mixed with dilution water.

SUMMARY OF THE INVENTION

In keeping with one aspect of this invention polymer activation apparatus includes an impeller in a mixing chamber. The chamber has a first inlet for a polymer emulsion, a second inlet for dilution water, and an outlet. The impeller includes a circular disk having a plurality of internal channels which extend from an eye at the rotational axis of the impeller to the impeller edge. The eye extends through the top surface of the impeller, and a shaft is secured to the bottom surface of the impeller to rotate it.

The polymer and water inlets extend within about 1 inch of the impeller eye, and are oriented so that the polymer and water are placed directly into the eye of the impeller, preferably in less than about 11 milliseconds of the time the polymer and water make initial contact. This subjects the solution to high shear forces immediately, which discourages the polymer from forming a large number of gel aggregates. The impeller mixes the solution for a desired time in the chamber and the solution leaves through the chamber outlet.

BRIEF DESCRIPTION OF THE DRAWINGS

These and other features of the invention and the manner of obtaining them will become more apparent, and the invention will be best understood with reference to the following drawings, in which.

DETAILED DESCRIPTION

Figure 1:
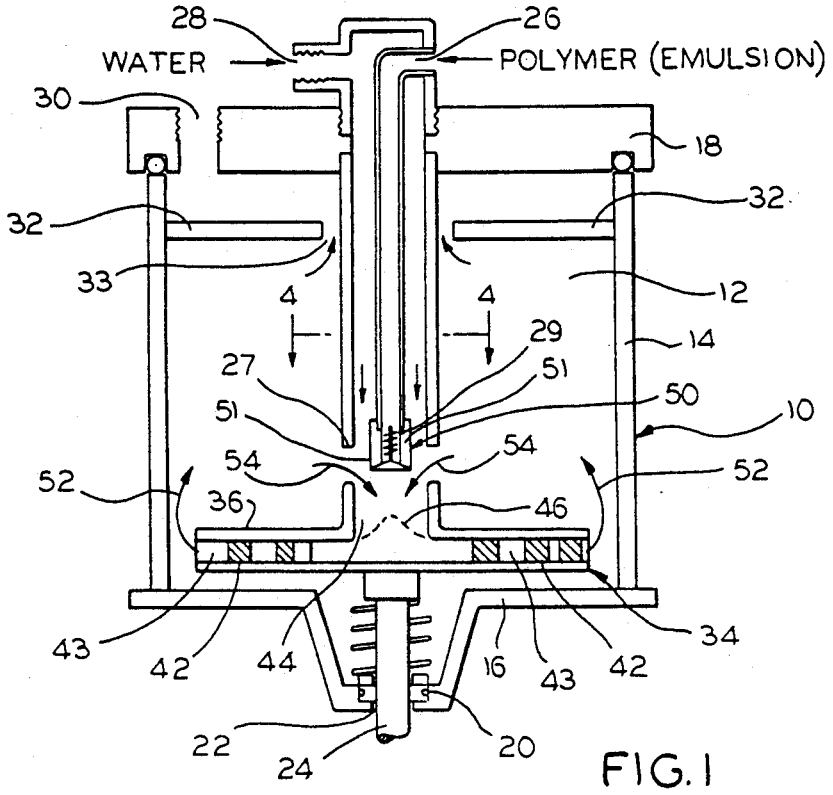
FIG. 1 is a partially cutaway elevational view of apparatus made in accordance with the principles of this invention.

As seen in FIG. 1, polymer activation apparatus 10 includes a chamber 12 having an outer wall 14, a bottom 16 and top 18. The bottom 16 has a seal 20 in an opening 22, and a shaft 24 extends through the seal 20.

Figure 4:
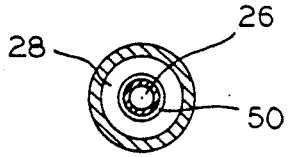
FIG. 4 is a sectional view of a portion of the apparatus in FIG. 1, taken along lines 4—4 in FIG. 1.

A selected polymer emulsion enters the chamber 12 through a polymer inlet 26, and water enters the chamber 12 through a water inlet 28. The inlets 26 and 28 are concentric cylinders (FIG. 4), with the polymer inlet 26 surrounded by the water inlet 28. Also, ends 27, 29 (FIG. 1) of the inlets 26, 28 are adjacent each other, with the end 29 being slightly inside the inlet 26. In this manner, the polymer is initially introduced to pure dilutant water which is not already in solution with polymer.

The polymer/water solution leaves the chamber 12 through an outlet 30. A baffle 32 may be provided, if desired, to restrict the solution in the chamber 12 and control the residence time of the solution in the chamber. The baffle 32 affects the shear forces and circulation in the chamber, and should be located to produce shear forces and circulation which do not damage the polymer molecules. The baffle 32 can be adjustable to change the volume of the chamber to create different operating conditions, if desired. After mixing, the solution passes through an opening 33.

Figure 2:
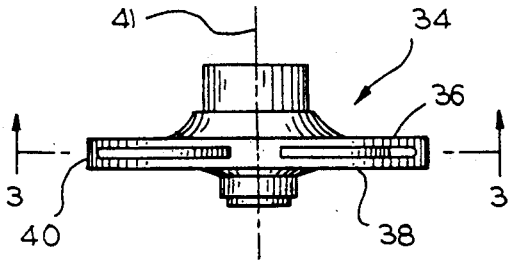
FIG. 2 is a detail view of the impeller in the apparatus of FIG. 1.
Figure 3:
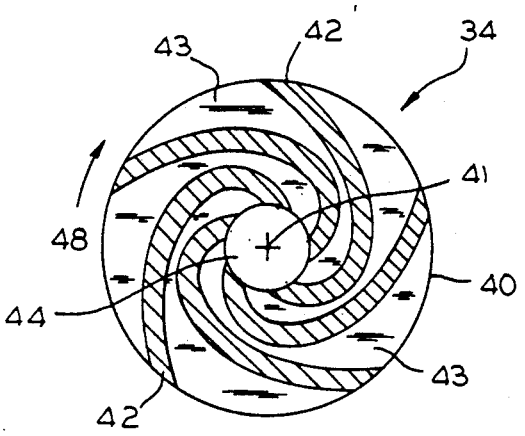
FIG. 3 is a sectional view of the impeller shown in FIG. 2, taken along lines 3—3 in FIG. 2.

An impeller 34 is provided which has a flat top surface 36, a flat bottom surface 38, and a circular outer edge 40, as seen in FIGS. 2 and 3. The impeller 34 rotates about an axis 41.

The impeller 34 includes a plurality of internal channels 42 (FIG. 2) which are formed by dividers 43. The channels 42 extend from an eye 44 at the axis 41 of the impeller 34 to the outer edge 40. The eye 44 extends through the top surface 36, as seen in FIG. 1.

The shaft 24 is secured to the bottom surface 38 for rotation of the impeller 34 at any desired rate, such as between about 600 and 3600 rpm. When the impeller 34 rotates, a vacuum, shown generally by dotted line 46 in FIG. 1, is created adjacent the eye 44. The strength of the vacuum in the space around the line 46 is related to the rate of rotation of the impeller 34.

A check valve 50 secured to the inlet 26 controls the polymer flow into the chamber, and prevents the vacuum in the space 46 from drawing the polymer out of the inlet 26 at an undesired rate. The check valve 50 preferably releases the polymer radially around the perimeter of the valve 50 through side openings .51, so that the polymer molecules are better separated when they meet the water. This results in faster dissolution of the polymer molecules. The check valve 50 also includes a spring 53 which determines the pressure required to open the valve 50. The spring 53 is preferably inside the polymer inlet 26, however, so that it does not become clogged with diluted polymers.

The internal channels 42 may be any suitable configuration, including the curved shape shown in FIG. 2. The preferred direction of rotation for the impeller 34 shown in FIG. 2 is indicated by the arrow 48.

The ends of the inlets 26 and 28 are preferably coaxial with the eye 44. The inlets 26 and 28 are separated from the eye 44 by a vertical distance of about 1 inch or less. The distance between the inlets and the eye is selected to permit the solution to circulate around and through the impeller 34, as will be seen, while also subjecting the polymer/water solution to sufficiently high shear forces within about 11 milliseconds of initial mixing, to discourage agglomeration and initiate activation.

In use, a selected polymer enters the chamber 12 through the inlet 26 while dilution water is simultaneously fed into the chamber 12 through the inlet 28. The impeller 34 is rotated at a suitable rate, creating a vacuum in the space 46, and the polymer and water are drawn into the eye 44 of the impeller by the vacuum. Initial mixing occurs in the eye 44, where the solution is subjected to substantial shear forces. The high shear forces prevent or substantially reduce the tendency of the polymer to agglomerate. The solution is mixed further as it is forced through the channels 42 and out of the impeller 34 at its outer edge 40, as indicated by arrows 52 in FIG. 1. Also, the solution can re-enter the eye 44 of the impeller in the manner shown by arrows 54. The solution is removed when the polymer molecules have been subjected to desired shear forces for a desired period of time.

The many advantages of this invention are now apparent. Polymer agglomeration is discouraged by initially mixing the polymer and dilution water in the eye of the impeller, which immediately subjects the solution to high shear forces, resulting in improved polymer dilution and activation. Also, the dilution water does not have polymer in it when the water and polymer are initially mixed, which also discourages agglomeration and improves dilution and activation.

While the principles of the invention have been described above in connection with specific apparatus and applications, it is to be understood that this description is made only by way of example and not as a limitation on the scope of the invention.

What is claimed is:

1. Apparatus for mixing a polymer emulsion in dilution water to form a solution comprising a chamber having a first inlet for the polymer emulsion, a second inlet for the water and an outlet for removing the solution of polymer and water from said chamber;

an impeller having a flat top surface, a flat bottom surface, and a circular outer edge, said impeller being rotatable about a central axis;

means for rotating said impeller at a selected rate of rotation;

said impeller having an eye in said top surface and a plurality of spaced internal tongues which form internal channels extending from said eye to said outer edge, said impeller creating a vacuum in a space in and adjacent to said eye and centrifugal force at said edge when said impeller rotates, so that polymer and water entering said inlets passes through said eye and said channels under pressure;

said inlets extending adjacent to said eye to place the polymer and water in said eye and said vacuum space within a distance of about 1 inch of said eye, said inlets being spaced away from said eye to permit a portion of the solution to re-enter said eye; and check valve means secured to said polymer inlet for controlling the entry of the polymer into said eye, said channels and said chamber;

whereby the polymer is mixed with the water without substantial agglomeration of polymer molecules into gel aggregates.

* * * * *